US006434992B1

(12) United States Patent
Vodopyanov

(10) Patent No.: US 6,434,992 B1
(45) Date of Patent: Aug. 20, 2002

(54) FILLET ROLLING SUPPORT ROLLER

(75) Inventor: Eugene Vodopyanov, Oak Park, MI (US)

(73) Assignee: Hegenscheidt-MFD Corporation, Sterling Heights, MI (US)

( * ) Notice: Subject to any disclaimer, the term of this patent is extended or adjusted under 35 U.S.C. 154(b) by 0 days.

(21) Appl. No.: 09/776,820

(22) Filed: Feb. 5, 2001

(51) Int. Cl.[7] ..... B21D 15/00
(52) U.S. Cl. ..... 72/110; 72/107
(58) Field of Search ..... 72/107, 110; 29/6.01

(56) References Cited

U.S. PATENT DOCUMENTS

| | | | | |
|---|---|---|---|---|
| 3,434,322 A | * | 3/1969 | Cowles et al. | 72/107 |
| 3,735,620 A | * | 5/1973 | Naumann | 72/107 |
| 4,173,134 A | * | 11/1979 | Huuskonen et al. | 72/110 |
| 4,299,017 A | | 11/1981 | Gottschalk | |
| 5,806,184 A | | 9/1998 | Lonero et al. | |
| 6,094,956 A | | 8/2000 | Vodopyanov et al. | |

FOREIGN PATENT DOCUMENTS

| | | | | |
|---|---|---|---|---|
| JP | 59-67312 | * | 4/1984 | 72/110 |

* cited by examiner

*Primary Examiner*—Ed Tolan
(74) *Attorney, Agent, or Firm*—Carlson, Gaskey & Olds

(57) ABSTRACT

The present invention provides a support tool for supporting a crankshaft journal during machining. The support tool includes a support housing having an opening and a support roller having a central portion received in the opening. The central portion is supported in the opening, preferably by a plurality of needle bearings, and includes opposing end portions. Opposing roller portions extend radially outwardly from each of the opposing end portions. The opposing end portions have an outer cylindrical support surface for supporting a crankshaft journal. Each of the opposing roller portions include a lateral crankshaft engagement surface and an inner surface in spaced relationship from the lateral crankshaft engagement surface. The inner surfaces are arranged adjacent to the support housing. An annular corner joins the outer cylindrical support surface and the lateral crankshaft engagement surface and is arranged within a tangential plane on the outer cylindrical support surface. In this manner, the support rollers are permitted to slide a limited amount on the crankshaft journals, and the hardened lateral crankshaft engagement surfaces are permitted to contact the thrust walls of the crankshaft without damage to the support rollers or the crankshaft journal or thrust walls.

12 Claims, 3 Drawing Sheets

FILLET ROLLING SUPPORT ROLLER

BACKGROUND OF THE INVENTION

This invention relates to a fillet rolling tool for deep rolling journal fillets, and more particularly, the invention relates to a support tool for supporting the journal during deep rolling.

Deep rolling has been used for many years to strengthen the journal fillets of components such as engine crankshafts. The fillets are mechanically worked and plastically deformed by a rolling tool to strengthen the fillets and relieve stress in the area of the fillets. Typically, a pair of opposing work tools are used to roll the journal fillets. One tool includes a pair of rollers to support the lower portion of the journal while an upper tool containing at least one work roller is used to engage the journal fillet and mechanically work the fillet area. The upper and lower work tools are actuated towards one another using a hydraulic cylinder to apply pressure in the area of the journal fillet. The work piece, such as a crankshaft, is driven along its axis to roll the journal fillets. The work roller is subjected to several thousand pounds of force during the deep rolling process. These high rolling forces may accelerate tool fatigue in the presence of an undesirable amount of relative lateral movement between the crankshaft and tools.

It is common that the crankshaft may move laterally during the deep rolling process. As a result, the lateral motion introduces undesirable stresses that may fatigue the tools and cause then failure. To this end, several support tools have been developed to either prevent or minimize the effects of lateral movement between the support roller and the crankshaft thrust walls. One such tool incorporates a pair of projections extending radially from the support roller, which is received in the journal fillets to laterally locate the lower tool relative to the journal. The main journals of a crankshaft typically have different widths. For example, the main thrust journal of a crankshaft is typically wider than the other main journals of the crankshaft. Accordingly, a support roller having radial projections cannot be used for all of the main journals of the crankshaft. As a result, special support rollers must be made for the main thrust journal, which is costly. Another prior arrangement adapted for journal furnishing utilizes pads on the lateral portions of the support housing, which are permitted to collide with the thrust faces of the crankshaft. This arrangement is undesirable because the support tool must be specifically modified to accommodate the pads and may compromise the design and performance of the lower tool. Therefore, what is needed is a roller tool having support rollers suitable for use in supporting the crankshaft journals during deep rolling while minimizing the effects of lateral crankshaft movement.

SUMMARY OF THE INVENTION

The present invention provides a support tool for supporting a crankshaft journal during machining. The support tool includes a support housing having an opening and a support roller having a central portion received in the opening. The central portion is supported in the opening, preferably by a plurality of needle bearings, and includes opposing end portions. Opposing roller portions extend radially outwardly from each of the opposing end portions. Preferably, one of the opposing end portions is formed integrally with an end portion of the central portion, and the other opposing end portion is removably secured to the other opposing end portion. The opposing end portions have an outer cylindrical support surface for supporting a crankshaft journal. Each of the opposing roller portions include a lateral crankshaft engagement surface and an inner surface in spaced relationship from the lateral crankshaft engagement surface. The inner surfaces arranged adjacent to the support housing. An annular corner joins the outer cylindrical support surface and the lateral crankshaft engagement surface and is arranged within a tangential plane on the outer cylindrical support surface. That is, the annular corner does not extend outwardly from the outer cylindrical support surface. The support rollers are preferably constructed from a OHTS steel having a hardness in the range of approximately 60–64 Rockwell C. In this manner, the support rollers are permitted to slide a limited amount on the crankshaft journals, and the hardened lateral crankshaft engagement surfaces are permitted to contact the thrust walls of the crankshaft without damage to the support rollers or the crankshaft journal or thrust walls.

Accordingly, the present invention provides a roller tool having support rollers suitable for use in supporting the crankshaft journals during deep rolling while minimizing the effects lateral crankshaft movement.

BRIEF DESCRIPTION OF THE DRAWINGS

Other advantages of the present invention can be understood by reference to the following detailed description when considered in connection with the accompanying drawings wherein.

DETAILED DESCRIPTION OF A PREFERRED EMBODIMENT

Figure 1:
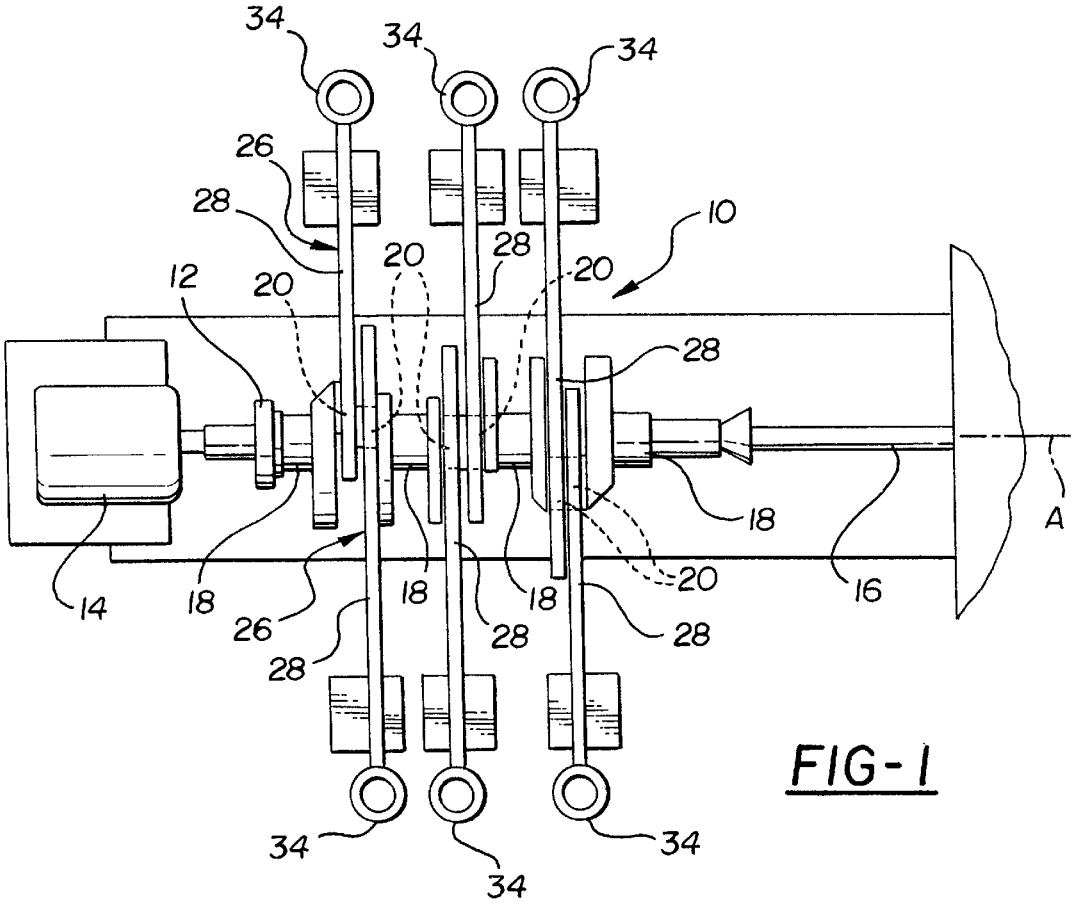
FIG. 1 is a top elevational view of a fillet rolling machine.

A fillet rolling assembly 10 is shown in FIG. 1 for deep rolling fillets of work pieces such as a crankshaft 12. The crankshaft 12 is supported in the fillet rolling assembly 10 by a headstock with a drive motor 14 and a tailstock 16. The drive motor 14 drives the crankshaft about an axis A to deep roll the journal fillets. The crankshaft 12 includes main journals 18 and pin journals 20 that are spaced from the axis A.

Figure 2:
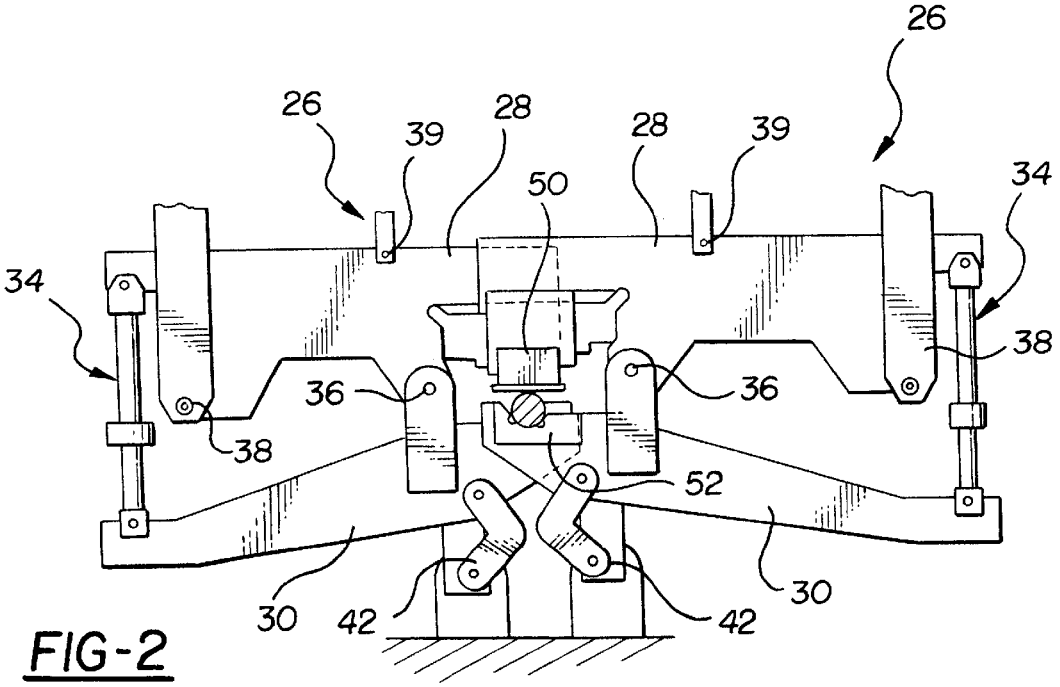
FIG. 2 is a side elevational view of the fillet rolling machine shown in FIG. 1.

Referring to FIGS. 1 and 2, the fillet rolling assembly 10 includes jaw assemblies 26 that have an upper jaw 28 and a lower jaw 30 pivotally connected by a clevis 36. A hydraulic actuator 34 is disposed between ends of the upper 28 and lower 30 jaws to close the opposite end of the jaw assemblies 26 together to deep roll the journal fillets. The jaw assemblies 26 are suspended within the fillet rolling assembly 10 by upper supports 38, 39, for moving the jaw assemblies 26 toward and away from the crankshaft 12 as the crankshafts 12 are loaded and unloaded from the fillet rolling assembly 10. The lower jaw 30 of the jaw assembly 26 is pivotally connected to the base of the machine 10 by a linkage 42 which is used to limit lateral movement of the jaw assemblies 26. As the crankshaft 12 is driven about axis A, the jaw assemblies 26 orbit about the axis A and deep roll the journal fillets. In spite of the use of the linkage 42 or other similar devices, an undesirable amount of lateral crankshaft movement may occur.

Figure 3:
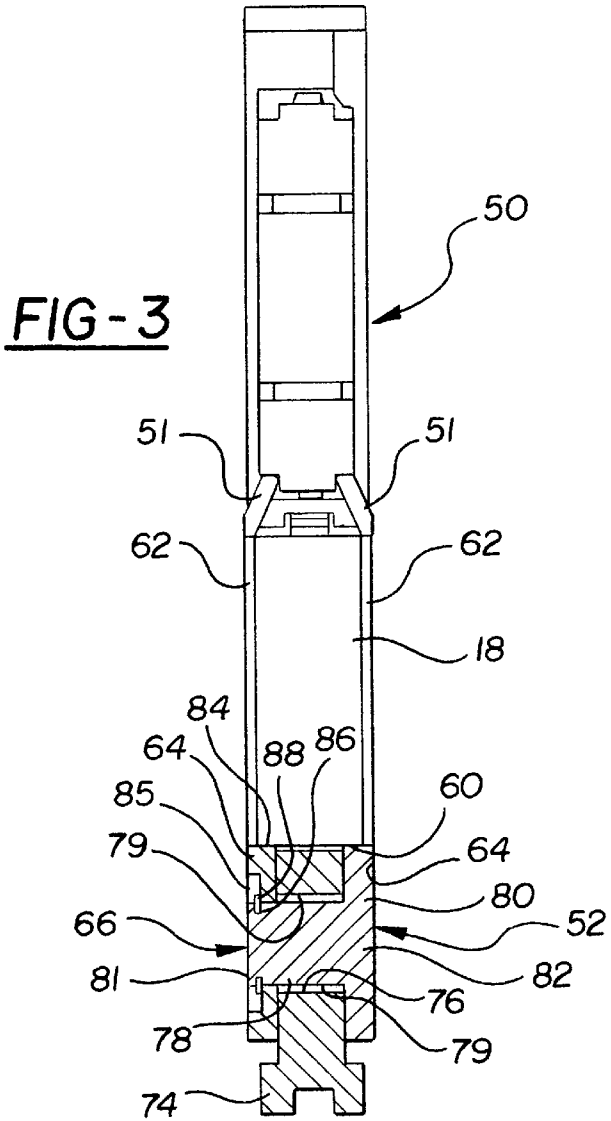
FIG. 3 is a cross-sectional view of the fillet rolling tools used in deep rolling journal fillets.
Figure 5A:
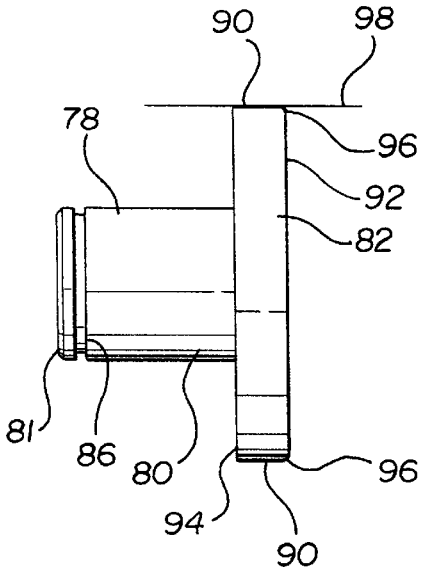
FIG. 5A is a front elevational view of a central portion and integrally formed opposing roller portion.
Figure 5B:
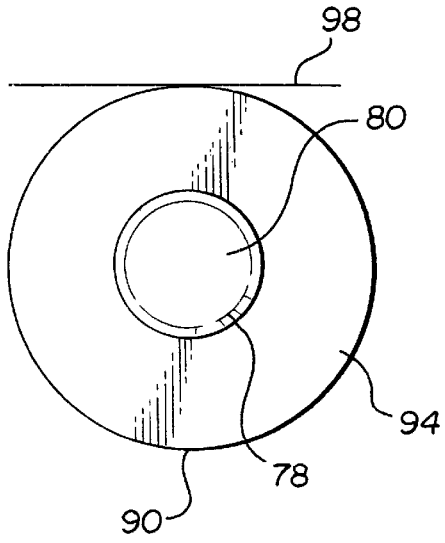
FIG. 5B is a side elevational view of the support roller shown in FIG. 5A.
Figure 6A:
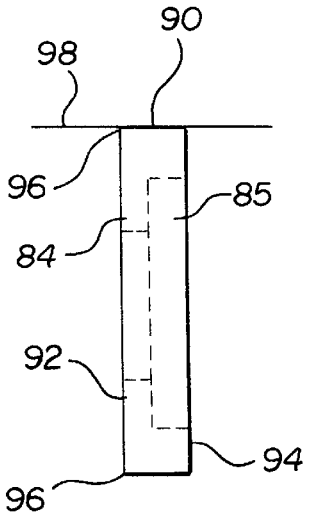
FIG. 6A is a front elevational view of a removable opposing roller portion.
Figure 6B:
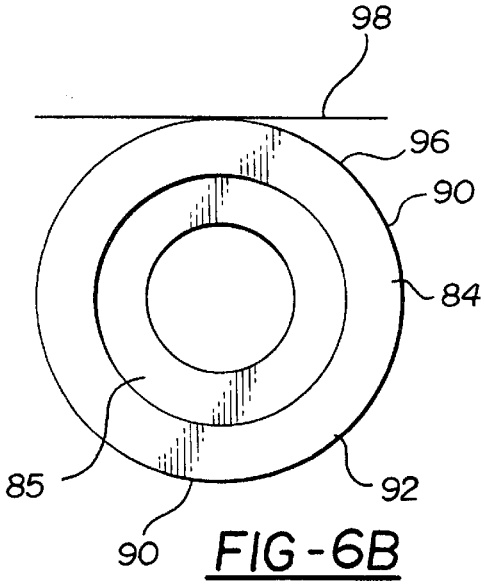
FIG. 6B is a side elevational view of the removable roller portion shown in FIG. 6A.

The upper 28 and lower 30 jaws respectively include upper 50 and lower 52 work tools. The lower tool 52 includes a pair of support roller 66 that engage and support a bearing surface 60 of a journal of a crankshaft, as shown in FIG. 3. Each journal typically includes a shoulder 64, or thrust bearing surface, and a fillet 62 arranged between the shoulder 64 and the bearing surface 60. The main journals 18 are received within the engine block to support the crankshaft 12 for rotation about axis A within the engine. Connecting rods are secured to the pin journals 20 for transferring force from the pistons to rotate the crankshaft 12 about axis A within the engine. The crankshafts 12 are typically cast of iron and include stress concentrations in the area of the fillets 62. Deep rolling the fillets 62 relieves the stress in the area of the fillets 62 so that the crankshaft 12 will not fracture during normal engine operation. The upper tool 50 includes work rollers 51 that mechanically work the fillets 62 to relieve the stress concentrations.

Figure 4:
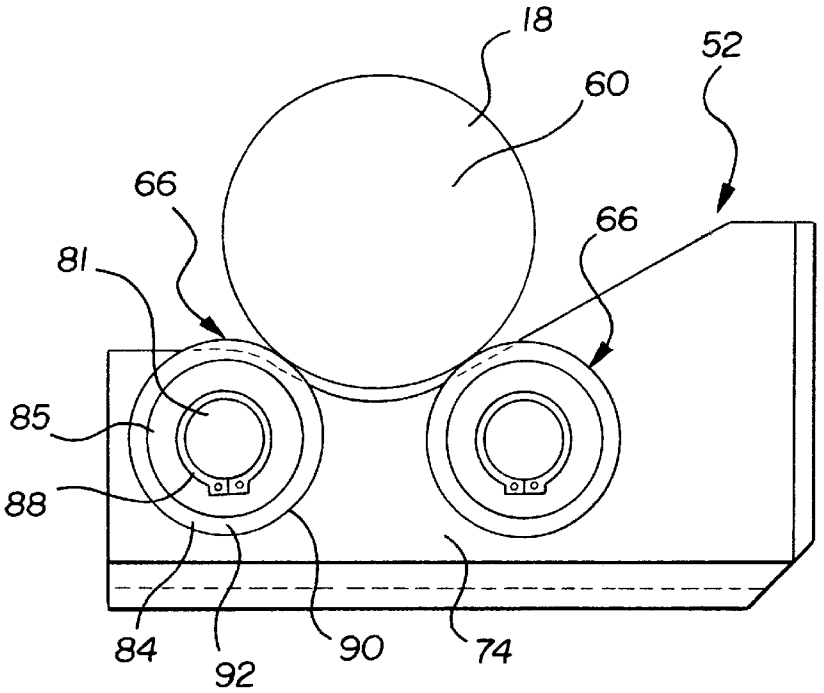
FIG. 4 is a side elevational view of the roller support tool.

Referring to FIGS. 3 and 4, a roller support tool 52 is shown supporting a main journal 18. The roller support tool 52 has a housing 74 with an opening 76 for receiving a central portion 78 of the support roller 66. The central portion 78 is supported in the opening 76 by plurality of needle bearings 79 to minimize the friction between the two members. In the preferred embodiment, the support roller 66 includes an integrally formed opposing roller portion 82 extending radially from an end portion 80 of the central portion 78. A removable roller portion 84 is removably secured to another end portion 81 of the central portion 78 with a retainer 88. The retainer 88 is received in a groove 86 in the end portion 81. The roller portion 84 includes a recess 85 that receives a retainer 88.

The main journal 18 shown in FIG. 3 is a non-thrust bearing. That is, it is not the widest main journal on the crankshaft. The support roller 66 is approximately the entire width of the non-thrust main journals 18 so that maximum support may be provided to the main journal 18 during the deep fillet rolling process. However, the same support roller 66 may be used for the main thrust journal, which is wider than the main journal 18. In this manner, the same support roller 66 maybe used for all of the main journals so that cost may be reduced.

The roller portions 82 and 84 include outer cylindrical surfaces 90 which directly support the crankshaft journal. Additionally, the roller portions include lateral crankshaft engagement surfaces 92, which are arranged adjacent to the thrust surfaces of the crankshaft journal. An inner surface 94 is spaced from the lateral crankshaft engagement surface 92 and is arranged adjacent to the housing 74 of the lower support tool 52. With the present invention, an annular corner 96 joins the lateral crankshaft engagement surface 92 and the inner surface 94. The annular corner 96 lies within a tangential plane 98 on the outer cylindrical surface. That is, the annular corner 96 does not extend outwardly from the outer cylindrical surface 90. The annular corner 96 may have a rounded contour or may be a flat chamfer.

Preferably, the support roller 66 is constructed from a OHTS steel that has a hardness in the range of approximately 60–64 Rockwell C (Rc). While it is desirable to control the lateral movement of the crankshaft to avoid collisions between the thrust surfaces of the crankshaft and the support rollers, inevitably such collisions occur. With the present invention, the support roller 66 and lower support tool 52 along the crankshaft journal in the event of lateral movement of the crankshaft. Under such a condition, the lateral crankshaft engagement surface 92 of the support roller 66 would contact with the thrust surface 64 of the crankshaft to limit the lateral crankshaft movement relative to the tools 50,52. However, the support roller 66 is sufficiently hard and polished to avoid any damage to the thrust surface. The contour of the annular corner 96 and the surface condition of the lateral crankshaft engagement surface 92 ensure that no damage is done to the crankshaft fillets 62 or thrust surfaces 64 of the crankshaft. In this manner, undesirable relative lateral movement may be limited and the tool life extended.

The roller portion 84 includes recess 85 that receives a retainer 88.

The invention has been described in an illustrative manner, and it is to be understood that the terminology that has been used is intended to be in the nature of the words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A support tool for supporting a crankshaft journal during machining comprising:

a support housing having an opening;

a support roller having a central portion received in said opening and having opposing end portions;

opposing roller portions extending from said opposing end portions and terminating in an outer cylindrical support surface for supporting the crankshaft journal, said opposing roller portions each including a lateral crankshaft engagement surface and an inner surface in spaced relation from said lateral crankshaft engagement surface and arranged adjacent to said support housing; and an annular corner joining said outer cylindrical support surface and said lateral crankshaft engagement surface, wherein said annular corner is within a tangential plane on said outer cylindrical support surface.

2. The support tool as set forth in claim 1, further including a plurality of needle bearings disposed in said opening and interposed between said support housing and said central portion.

3. The support tool as set forth in claim 1, wherein said corner has an arcuate contour.

4. The support tool as set forth in claim 1, wherein one of said opposing roller portions and said central portion are integrally formed with one another and the other of said opposing roller portions is removably supported on said central portion.

5. The support tool as set forth in claim 4, further including a retainer secured to said central portion for retaining said other of said opposing roller portion on said central portion.

6. The support tool as set forth in claim 5, wherein said central portion includes a groove and said retainer is a clip received in said groove.

7. The support tool as set forth in claim 1, wherein said opposing portions are constructed from OHTS steel.

8. The support tool as set forth in claim 7, wherein said opposing portions have a surface hardness in a range of approximately 60 to 64 Rc.

9. A method of locating a fillet rolling tool relative to a crankshaft journal during deep fillet rolling, comprising the steps of:

a) clamping a crankshaft journal with a fillet rolling tool;

b) rotating the crankshaft to deep roll a crankshaft journal fillet;

c) permitting a support roller to slide laterally relative to the crankshaft journal fillet; and d) engaging a thrust wall adjacent to the crankshaft journal with a lateral crankshaft engagement surface on the support roller to locate the fillet rolling tool on the crankshaft journal.

10. The method as set forth in claim 9, wherein the support roller includes opposing roller portions.

11. The method as set forth in claim 9, wherein the thrust wall is a polished service.

12. The method as set forth in claim 11, wherein the thrust wall has a service hardness of at least approximately 60 Rc.

* * * * *